US006588654B2

(12) United States Patent
Nakashima

(10) Patent No.: US 6,588,654 B2
(45) Date of Patent: Jul. 8, 2003

(54) CUP HAVING SAFETY STRUCTURE

(76) Inventor: Setsuo Nakashima, 2-3-9, Kamitsuchii, Gifu-shi, Gifu-ken (JP), 502-0803

( * ) Notice: Subject to any disclaimer, the term of this patent is extended or adjusted under 35 U.S.C. 154(b) by 0 days.

(21) Appl. No.: 09/855,193

(22) Filed: May 14, 2001

(65) Prior Publication Data

US 2002/0130170 A1 Sep. 19, 2002

(51) Int. Cl.[7] ..... B65D 3/28
(52) U.S. Cl. ..... 229/402; 229/117.12; 229/400
(58) Field of Search ..... 229/4.5, 117.12, 229/400, 402; 220/669, 771, 772

(56) References Cited

U.S. PATENT DOCUMENTS

| | | | | | |
|---|---|---|---|---|---|
| 1,172,483 | A | * | 2/1916 | Rike et al. | 229/400 |
| 2,435,906 | A | * | 2/1948 | Shapiro | 229/4.5 |
| 3,157,335 | A | * | 11/1964 | Maier | 229/400 |
| 3,223,305 | A | * | 12/1965 | Edwards | 229/400 |
| 3,327,895 | A | * | 6/1967 | Mueller | 229/400 |
| 3,495,736 | A | * | 2/1970 | Ragettli | 229/400 |
| 3,628,719 | A | * | 12/1971 | Ford, Sr. | 229/117.12 |
| 3,781,183 | A | * | 12/1973 | Doll | 229/400 |
| 4,052,037 | A | * | 10/1977 | Mair et al. | 229/400 |
| 4,102,454 | A | * | 7/1978 | Karevaara | 229/102 |
| 4,609,113 | A | * | 9/1986 | Seki | 229/400 |
| 5,762,230 | A | * | 6/1998 | Policappelli | 220/669 |
| 5,868,272 | A | * | 2/1999 | Deal | 220/669 |

FOREIGN PATENT DOCUMENTS

| | | | | |
|---|---|---|---|---|
| JP | 4-327128 A | * | 4/1992 | 220/669 |
| JP | 6-144434 A | * | 6/1994 | 229/400 |

* cited by examiner

*Primary Examiner*—Gary E. Elkins
(74) *Attorney, Agent, or Firm*—Michaelson & Wallace; Peter L. Michaelson

(57) ABSTRACT

A cup having a safety structure has a cylindrical sidewall and a bottom wall closing a lower end of the sidewall. The cup has a bottomed cylindrical shape. The sidewall has at least one protrusion protruding outward in such a size and a shape as to hook a finger of a user. The protrusion may have substantially a linear shape extending along a circumference of the sidewall. Alternatively, the protrusion may have a broken line shape or a dot-chain line shape extending along a circumference of the sidewall. Alternatively, the protrusion may have a curved portion extending along a circumference of the sidewall so as to correspond to an outer edge shape of a palm between a thumb and an index finger of the user.

3 Claims, 11 Drawing Sheets

CUP HAVING SAFETY STRUCTURE

BACKGROUND OF THE INVENTION

1. Field of the Invention

This invention relates to a cup having a safety structure and is particularly applicable to a disposable cup for drinks and a urine test cup as well as a container for foods and drinks such as an instant noodle container or an instant soup container.

2. Description of the Related Art

Among a variety of conventional cups, paper cups are used in large quantities in fast food restaurants, vending machines and the like. Urine test cups are used in large quantities for diagnosis or urine test in medical institutes such as hospitals. A lot of large-sized cups are used as containers for drinks and foods like instant noodles or instant soups. These cups are made of a paper or a synthetic resin such as a polypropylene (PP), a polystyrene or a polyethylene. They are normally formed in a bottomed cylinder with an upper end opened and a lower end closed.

However, since an outer peripheral surface of the conventional cups is smooth, fingers of a user may slip in grasping the cup. Moreover, when the cup holds contents such as a drink, it has a considerable weight as a whole. Then, the user may drop the cup because of his or her carelessness or the like. On the other hand, some users may not be able to hold the cup with a sufficient grip, such as elderly persons or sick persons. Particularly, in case of the urine test cup, the users are such elderly persons or sick persons that need to go to a hospital for medical treatment and their grip is sometimes weak in comparison with healthy persons. Moreover, in case of the large-sized containers such as the instant noodle containers, the total weight is considerably large when holding the contents, so that the user needs to grasp the cup with an appropriate strong grip. That is, the conventional cups should be improved in a structure to enable users, particularly users with a weak grip in addition to common users to grasp the cup without fail and in safety.

BRIEF SUMMARY OF THE INVENTION

An object of the present invention is to provide a cup having a safety structure (referred to "safety cup" hereunder) that enables a user with a weak grip in addition to a common user to grasp the cup without fail and in safety.

According to a first aspect of the invention, a cup having a safety structure comprises: a cylindrical sidewall; and a bottom wall closing a lower end of the sidewall. The cup has a bottomed cylindrical shape. The sidewall has at least one protrusion protruding outward in such a size and a shape as to hook a finger of a user.

The protrusion may have substantially a linear shape extending along a circumference of the sidewall. Alternatively, the protrusion may have a broken line shape or a dot-chain line shape extending along a circumference of the sidewall. Alternatively, the protrusion may have a curved portion extending along a circumference of the sidewall so as to correspond to an outer edge shape of a palm between a thumb and an index finger of the user.

A plurality of the protrusions may be provided in a vertical direction of the sidewall at an interval corresponding to an interval of the fingers.

According to a second aspect of the invention, there is provided a manufacturing method of a cup having a bottomed cylindrical shape and a safety structure. The method comprises: a sidewall-forming step for forming a cylindrical sidewall by curving a blank of a material paper into a cylindrical shape; a bottom wall forming step for forming a bottom wall closing a lower end of the sidewall by joining a circular bottom paper made of a material paper on the lower end of the sidewall; and a protrusion-forming step for forming by pressing a protrusion on the blank so as to protrude outward in such a size and a shape as to hook a finger of a user.

The sidewall-forming step and the protrusion-forming step may use an inner die and an outer die. An outside of the inner die has a press surface of a shape corresponding to a shape of an inside surface of the sidewall. An inside of the outer die has a press surface of a shape corresponding to a shape of an outside surface of the sidewall. The press surface of the inner die has a protrusion of a shape corresponding to a shape of an inside surface of the protrusion. The press surface of the outer die has a groove of a shape corresponding to a shape of an outside surface of the protrusion. The blank is pressed between the inner die and the outer die in the sidewall-forming step and the protrusion-forming step so that the protrusion is formed simultaneously with forming the sidewall.

The protrusion-forming step may use a plurality of divided die pieces and a receiving die. Outsides of the divided die pieces have a press surface of a shape corresponding to a shape of an inside surface of the sidewall including the protrusion. An inside of the receiving die has a press surface of a shape corresponding to a shape of an outside surface of the sidewall including the protrusion. The sidewall is disposed in the receiving die after the sidewall-forming step. Then, the divided die pieces are disposed in the sidewall. Thereafter, the divided die pieces are moved away from each other so as to press the sidewall between the press surface of the divided die pieces and the press surface of the receiving die, thereby forming the protrusion in the protrusion-forming step.

The term "cup" in the specification and claim means not only a disposable cup for drinks, a urine test cup, and a container for drinks and foods such as an instant noodle container or an instant soup container, but also a container generally used for other similar purposes.

Further objects and advantages of the invention will be apparent from the following description, reference being had to the accompanying drawings, wherein preferred embodiments of the invention are clearly shown.

DETAILED DESCRIPTION OF THE INVENTION

Figure 1:
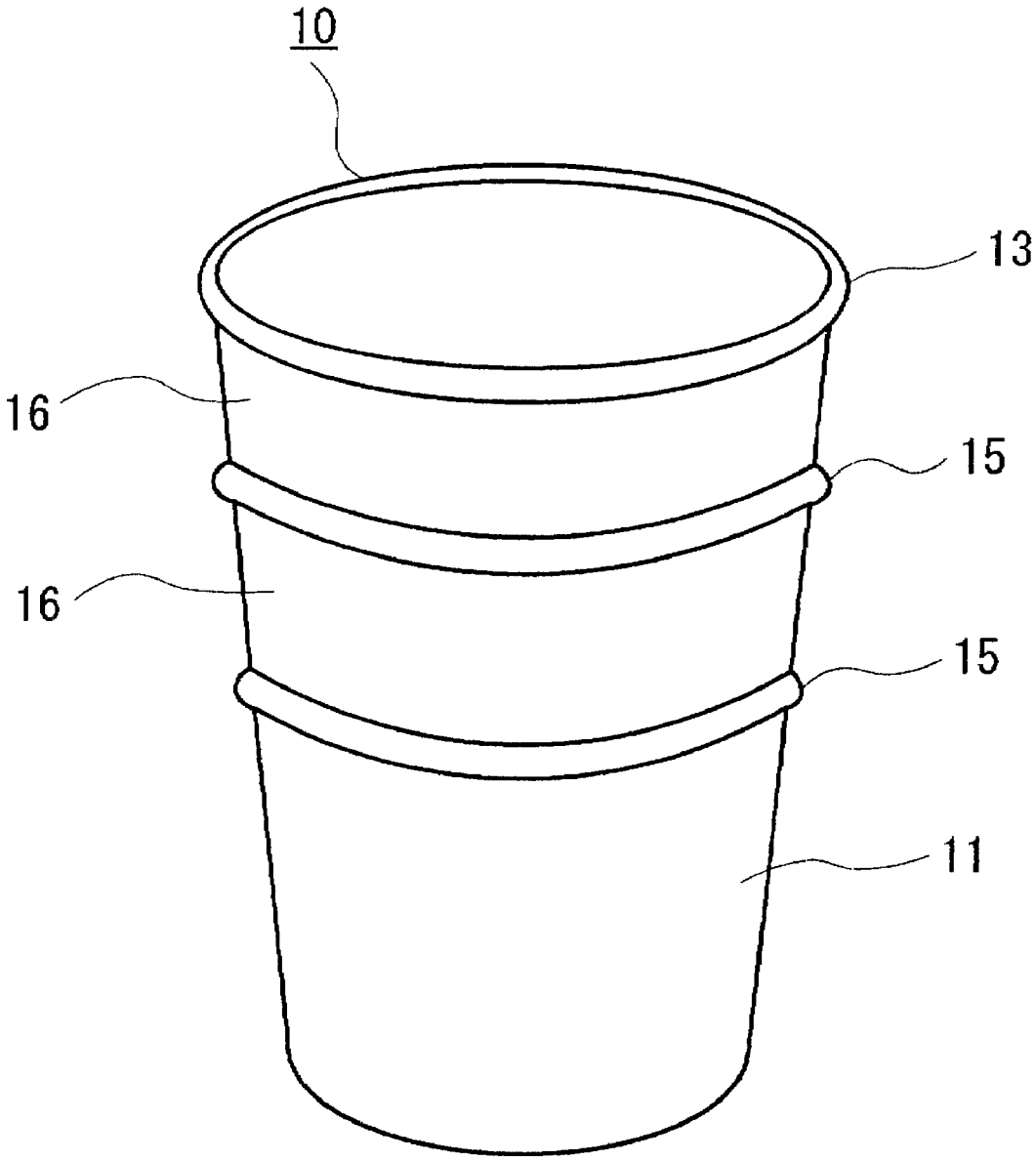
FIG. 1 is a perspective view of an entire safety cup according to a first embodiment of the invention.

Several embodiments of the invention are described hereunder referring to the attached drawings. The same reference character is used to show the same element throughout the several embodiments.

First Embodiment

Overall Structure

Figure 2:
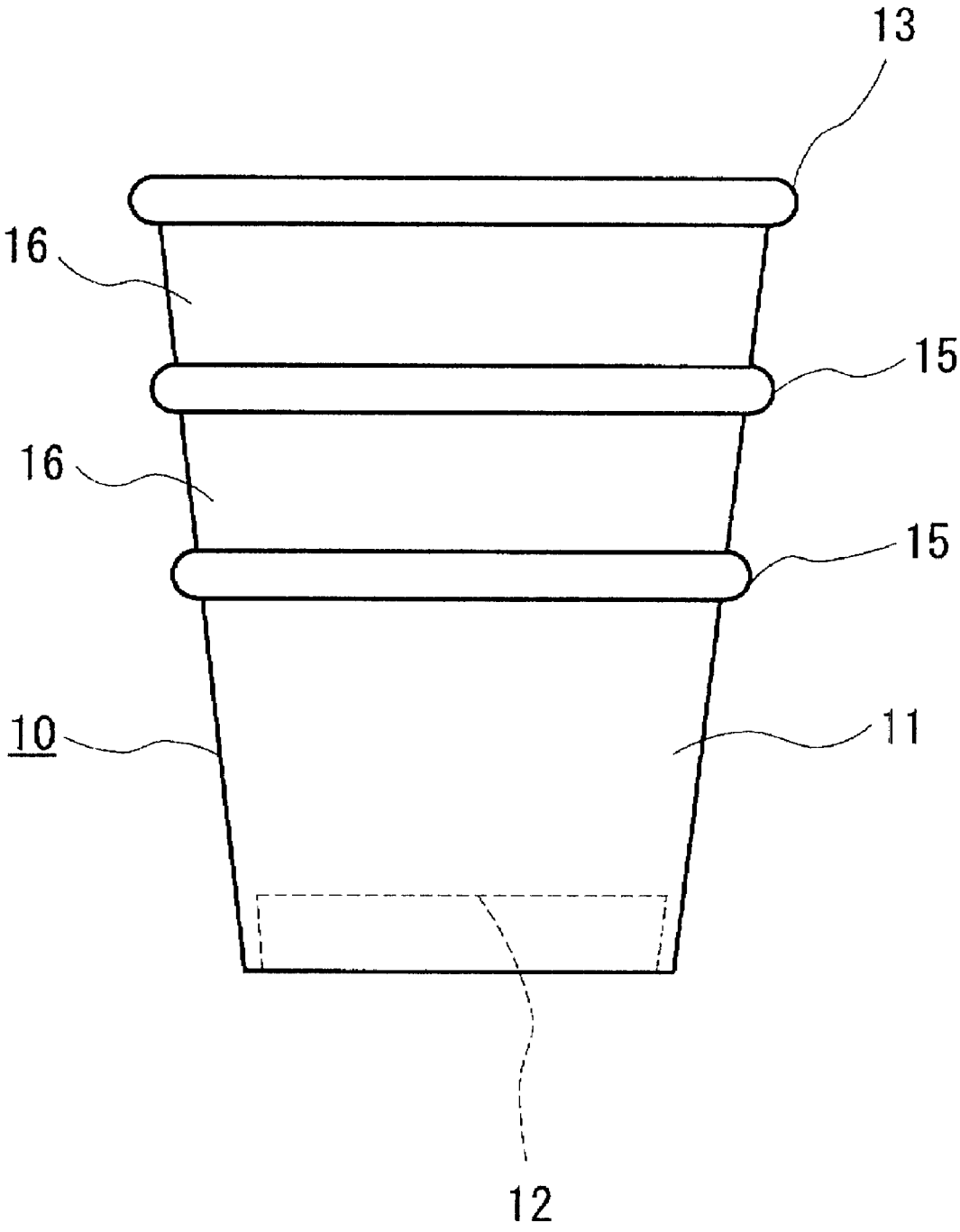
FIG. 2 is a front elevation of the entire safety cup according to the first embodiment of the invention.
Figure 3:
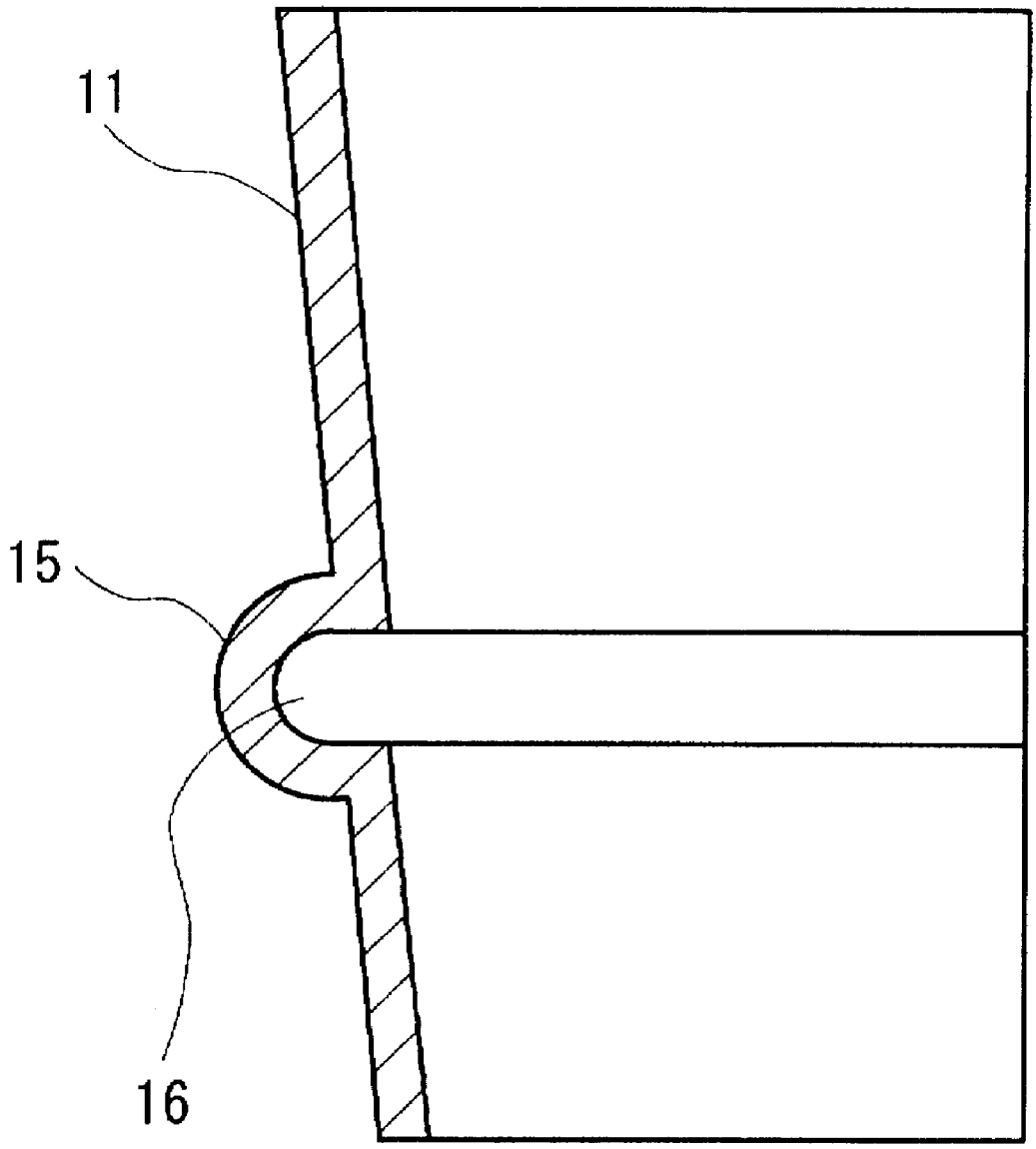
FIG. 3 is a cross-sectional view of a main part of the safety cup of the first embodiment.

FIGS. 1 and 2 illustrate an entire safety cup according to a first embodiment of the invention. FIG. 3 shows a cross-section of the safety cup of the first embodiment.

The first embodiment of the safety cup is concretized into a disposable paper cup 10. As shown in FIGS. 1 and 2, the entire shape of the paper cup 10 can be a bottomed cylinder like common paper cups, for example. The paper cup 10 has a cylindrical sidewall 11 and a bottom wall 12 covering and closing a lower end of the sidewall 11. Specifically, the first embodiment of the paper cup 10 is shaped into a hollow reverse cone with a bottom. An upper circumferential edge of the paper cup 10 is turned back to an outside in a curl shape to form a stepped part 13. The paper cup 10 may be made of a material that is used for common paper cups. For example, the paper cup 10 is made of a material paper which is obtained by laminating a synthetic resin film like a polyethylene film on a pulp paper.

On the other hand, the first embodiment of the paper cup 10 is a characteristic feature in one or more protrusions 15 provided on an outer peripheral surface of the sidewall 11. The protrusion 15 is provided on the sidewall 11 so as to protrude outward in such a size and a shape as to catch or hook one or more fingers of a user. Specifically, an entire shape of the protrusion 15 is a ring shape that extends linearly along a circumference of the sidewall 11 in its full length. As shown in FIG. 3, a cross-section of the protrusion 15 may be substantially a semi-circular shape, for example. In this case, the protrusion has its inside surface formed with a pressed groove 16 of a corresponding semi-circular cross-section. The cross-section of the protrusion 15 can be modified as desired as long as it has a convex shape. Instead of the semi-circle, it may be a semi-elliptical shape, a triangular shape, a rectangular shape, a trapezoidal shape or other polygonal shapes. Still, it is desirable to form the cross-section in the semi-circle or the semi-ellipse in order to facilitate a pressing work (press forming or the like) of the protrusion 15 in case the sidewall 11 is made of a paper material.

In the first embodiment, the protrusions 15 are arranged in two lines in a vertical direction of the sidewall 11 so as to be parallel to each other at an interval corresponding to an interval of fingers of a person who is supposed to be a user. Thus, a dented space 16 is formed between the protrusions 15 so as to accommodate the finger or fingers of the person. In the first embodiment, another dented space 16 is formed between the upper protrusion 15 and the stepped part 13. The protrusions 15 may be arranged in three or more lines in the vertical direction of the sidewall 11 so as to be parallel to each other at the interval corresponding to the interval of the fingers of the person or the user.

Manufacturing Method

Figure 4:
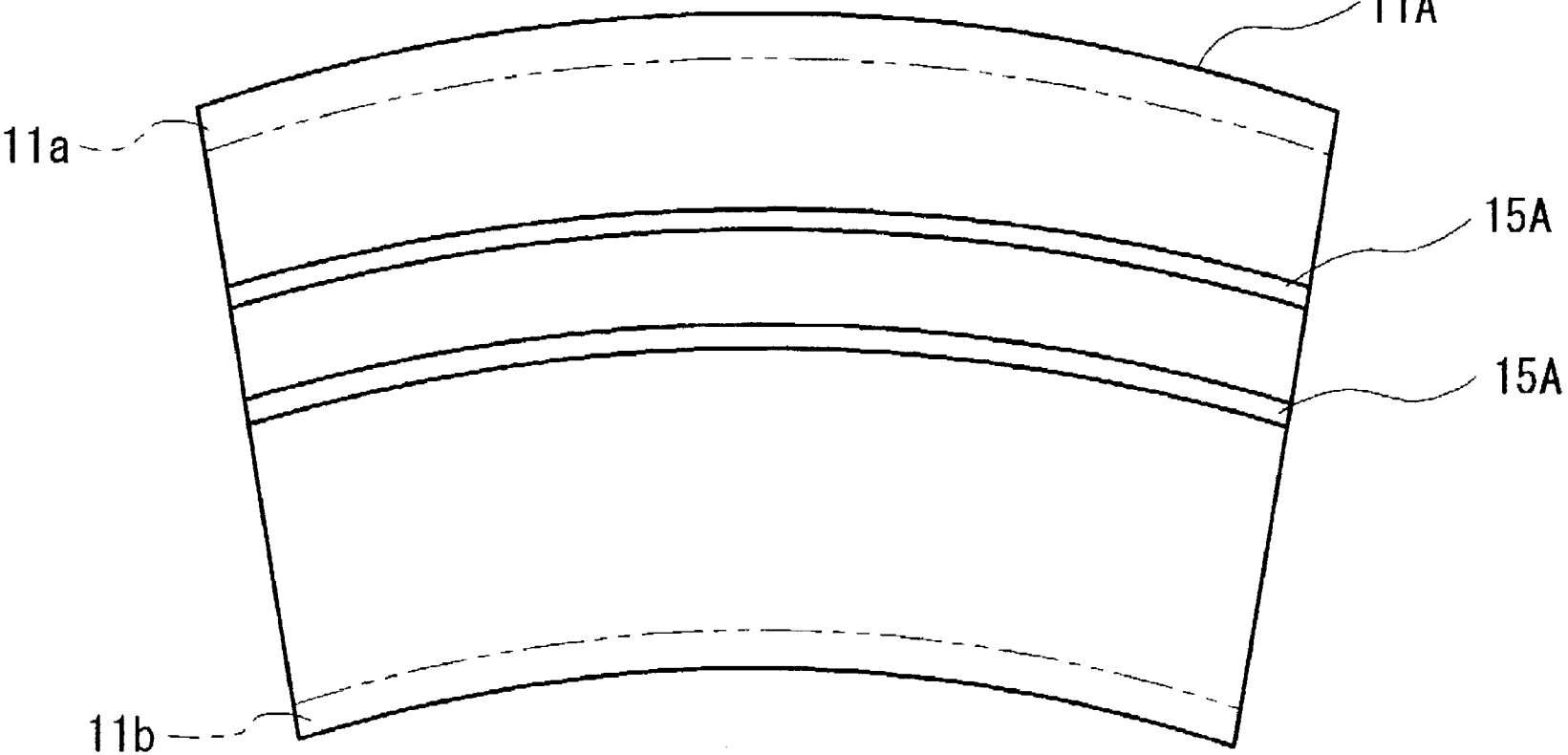
FIG. 4 is a plan view of a blank of substantially a trapezoidal sector shape that is used to form a sidewall of a paper cup according to the first embodiment of the invention.
Figure 5:
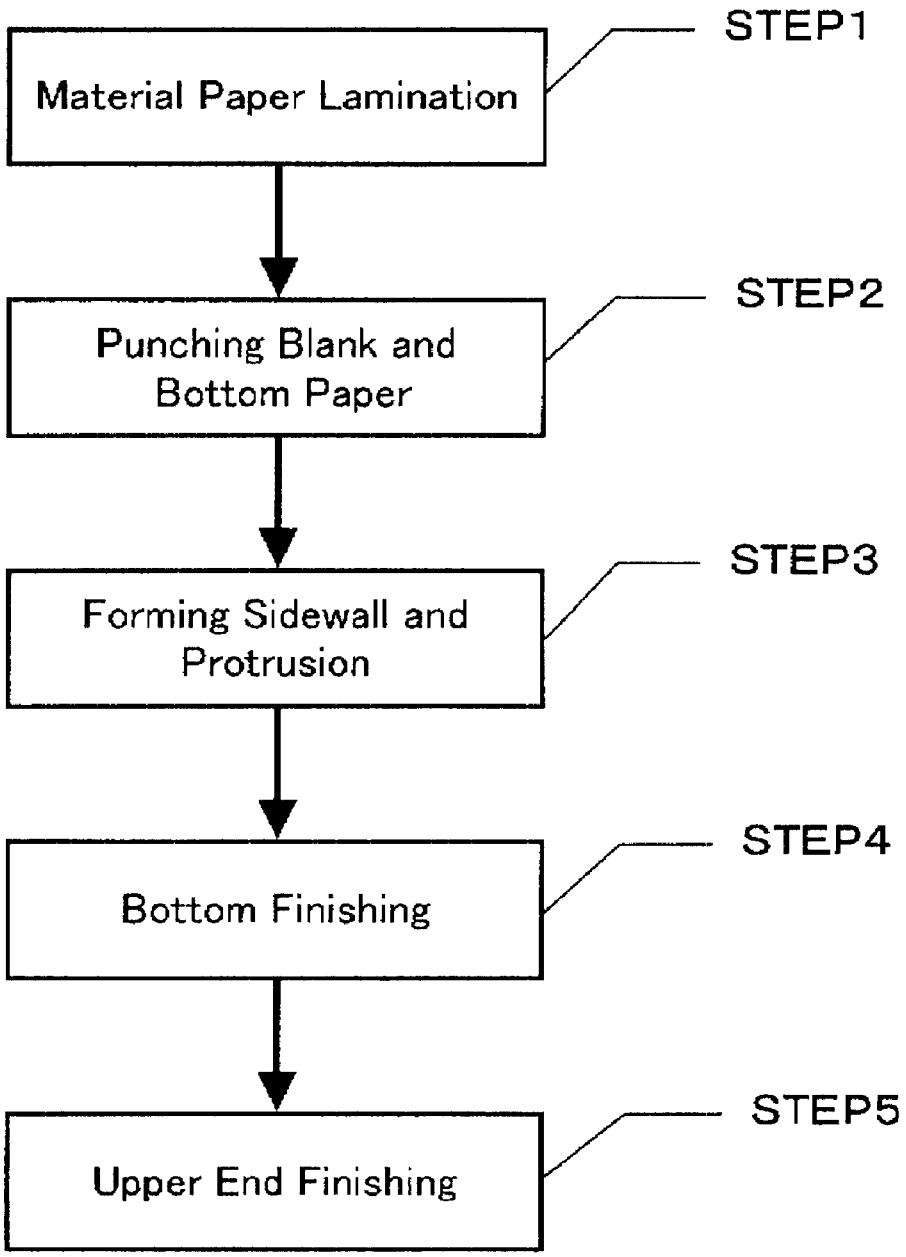
FIG. 5 is a flowchart showing each step of a manufacturing method of a paper cup according to a second embodiment of the invention.

FIG. 4 illustrates a blank of substantially a trapezoidal sector shape that is used to form a sidewall of a paper cup according to the first embodiment of the invention.

The first embodiment of the paper cup 10 uses a blank 11A of substantially a trapezoidal sector shape shown in FIG. 4 to form the sidewall 11. Specifically, as in a manufacturing process of common paper cups, a material paper is punched into a trapezoidal sector shape by use of a punching die in a first step, thereby forming a blank 11A of a flat trapezoidal sector shape. Then, the blank 11A is pressed to form the protrusions 15. For example, curved protrusions 15A are formed by pressing in parallel with a curved upper edge of the blank 11A at fixed lower positions (two positions) from the upper edge. The protrusions 15A can be entirely formed at the same time by use of pressing dies having curved press surfaces (pressing protrusion and pressing dent) corresponding to an arrangement or curved shape of the protrusion 15A of FIG. 4. Alternatively, the protrusions 15A can be formed by use of a rotating body (disc-shaped roller) or the like having a press surface of a cross-section corresponding to a cross-section of an inner surface of the protrusion 15A. In this case, the roller is rolled along a position at which the protrusion 15A is to be formed on the blank 11A, thereby forming it by pressing.

In FIG. 4, a folded margin 13*a* is provided at the upper edge of the blank 11A so as to be the stepped part 13. A folded margin 13*b* is provided at a lower edge of the blank 11A so as to be folded to an inside of the bottom wall 12. The blank 11*a* of such structure is curved into a cylindrical shape. Then, the opposite lateral side (right and left) edge portions thereof are overlapped and adhered to each other by heat sealing or the like. Thus, the sidewall 11 is formed.

Operation and Effects

According to the first embodiment, the user can stably grasp the paper cup 10 without fail by making his or her hand or fingers caught on the protrusions 15. As a result, even a user with a weak grip can grasp the cup without fail and in safety, as well as a common user as a matter of course. Then, if the first embodiment of the paper cup 10 is used as a urine test cup, it is effectively prevented that the user slips the finger on the cup or drops the cup. Thus, it is effectively prevented that urine in the cup 10 is spilled or spread out of the cup 10. Moreover, the protrusions 15 are provided in two lines in the vertical direction of the sidewall 11 at the interval corresponding to the interval of the fingers of the user. Thus, the user can make his or her fingers caught or hooked on the protrusions naturally or spontaneously. Consequently, the user can grip the paper cup 10 more stably.

Second Embodiment

The second embodiment relates to a specific manufacturing method of the first embodiment of the paper cup 10. FIG.

Figure 6:
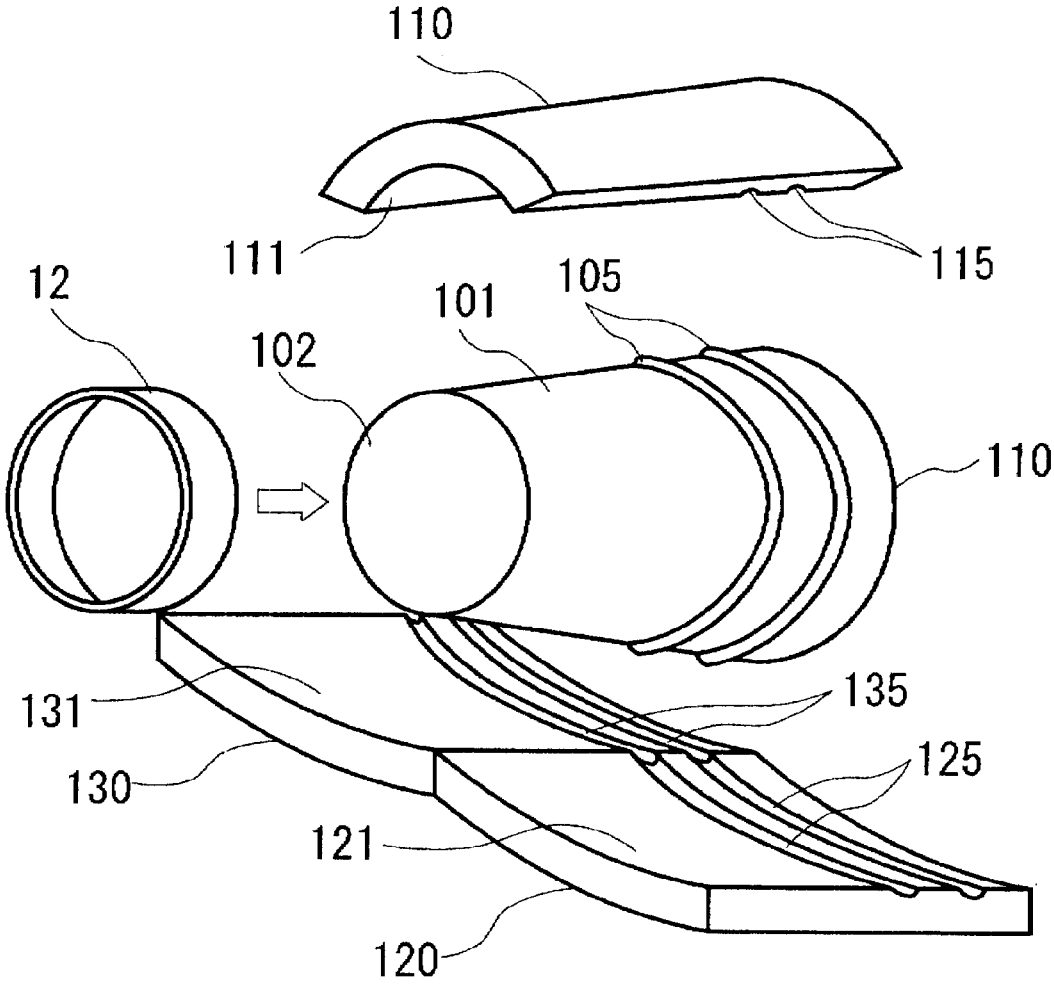
FIG. 6 is a perspective view of pressing dies that are used in a sidewall-forming step of the manufacturing method of the second embodiment of the paper cup and that are in an opened state.
Figure 7:
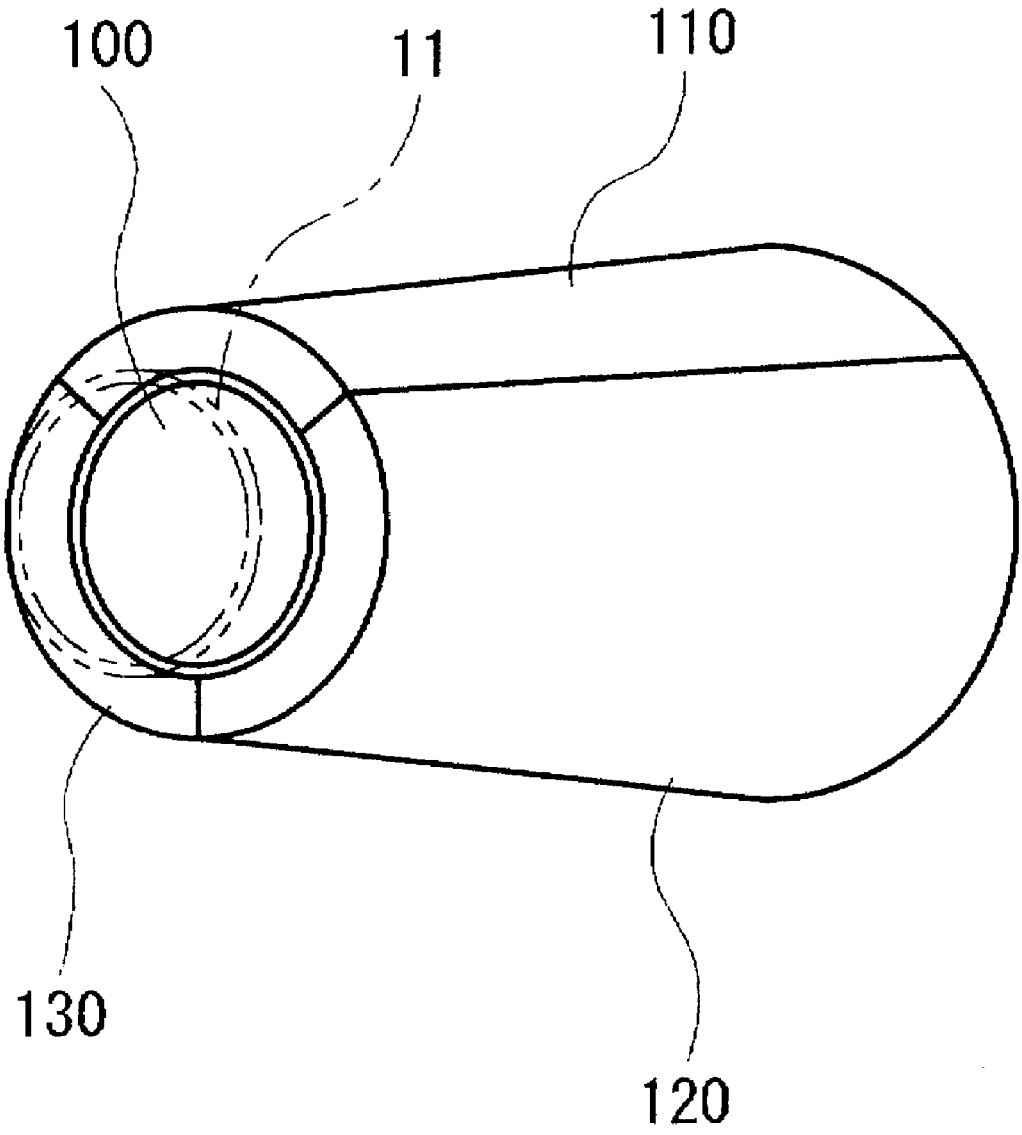
FIG. 7 is a perspective view of the pressing dies that are used in a sidewall-forming step of the manufacturing method of the second embodiment of the paper cup and that are in a closed state.
Figure 8:
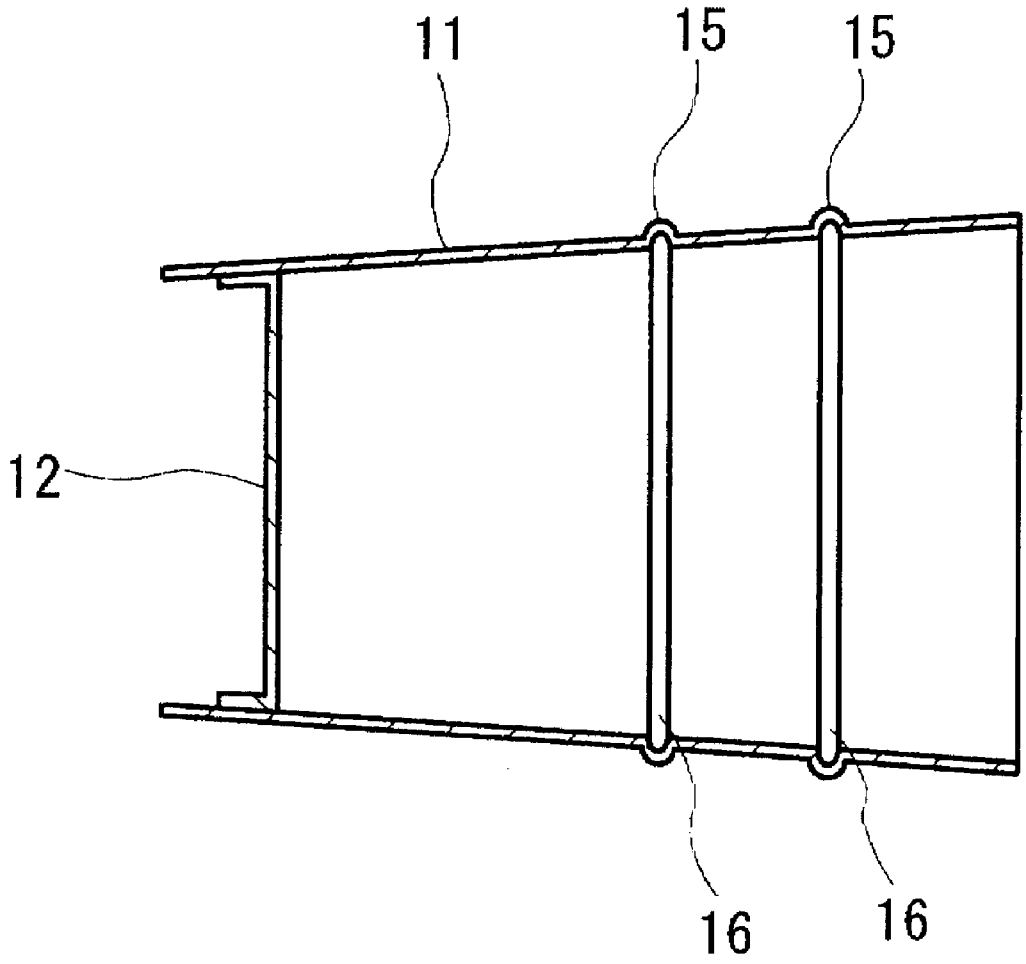
FIG. 8 is a cross-sectional view showing a shape of a paper cup after the sidewall-forming step.

5 shows each step of a manufacturing method of a paper cup according to a second embodiment of the invention. FIG. 6 illustrates pressing dies that are used in a sidewall-forming step of the manufacturing method of the second embodiment of the paper cup and that are in an opened state. FIG. 7 depicts a closed state of the pressing dies of FIG. 6. FIG. 8 illustrates a shape of a paper cup after the sidewall-forming step.

The manufacturing method of the paper cup 10 is basically the same as that of the common paper cups except that a protrusion-forming step is carried out simultaneously with a sidewall-forming step of STEP 3. Specifically, in a laminating step of STEP 1, a synthetic resin film such as a polyethylene film is stuck on one side surface of a material paper. Next, in a punching step of STEP 2, a blank 11A for forming the sidewall 11 is punched out of the material paper into substantially a trapezoidal sector shape by use of a punching die of a blank punching machine. On the other hand, a circular bottom paper for forming the bottom wall 12 is punched out of the material paper by use of a punching die of a bottom paper punching machine. Moreover, an outer circumferential portion of the bottom paper is die-cast inward into a fixed shape or bent to stand substantially perpendicularly to a lower surface side (synthetic resin film side), thereby obtaining the bottom wall 12.

Thereafter, in the sidewall-forming step of STEP 3, the sidewall 11 is formed first by use of a pressure joining machine shown in FIG. 6. The pressure joining machine has pressing dies composed of an inner die 100 and outer dies 110, 120 and 130. The inner die 100 has a press surface 101 of a truncated cone shape that is same as a shape of an inner peripheral surface of the paper cup 10. The outer dies are composed of three outer die pieces 110, 120 and 130. These outer die pieces 110, 120 and 130 are obtained by dividing a truncated cone shape, which is same as a shape of an outer peripheral surface of the sidewall 11, in the circumferential direction. The outer die pieces 110, 120 and 130 have press surfaces, respectively, obtained by dividing the shape of the outer peripheral surface of the sidewall 11.

In STEP 3, at first, an upper surface side of the bottom paper is sucked by vacuum to a circular bottom surface 102 of the inner die 100 of the pressing dies that are in the opening state. Next, one lateral edge portion of the inside surface (synthetic resin film side) of the blank 11A is heated by a burner or the like to melt the synthetic resin film. Then, the blank 11A is wound around the press surface 101 of the inner die 100 in a contacted state. Thereafter, as shown in FIG. 7, the pressing dies are closed so as to press the blank 11A between the press surface 101 of the inner die 100 and the press surfaces 111, 121, 131 of the outer dies 110, 120, 130. Thus, both the lateral edge portions of the blank 11A adhere to each other. At this time, the lower end portion of the sidewall 11 is projected outward a little from the pressing dies. However, in FIG. 7, such a projected portion is shown by two-dot chain line for clearly depicting the die closing state. In the second embodiment, the sidewall forming step and the protrusion-forming step are completed in the same step so that the protrusions 15 are formed simultaneously with the sidewall 11.

Specifically, two protrusions 105 are formed on the press surface 101 of the inner die 100. Each of the protrusions 105 has substantially a ring shape corresponding to each of the pressed grooves 16 that define the inner surface shapes of the protrusions 15. Two groups of grooves 115, 125, 135 are formed respectively on the press surfaces 111, 121, 131 of the outer dies 110, 120, 130. Each group of the grooves 115, 125, 135 has shapes corresponding to the shape of the outer surface of each of the protrusions 15. At the time of closing the pressing dies, each group of the grooves 115, 125, 135 become continuous so as to define a ring shape that is same as the ring shape of the outer surface of each of the protrusions 15. Moreover, each of the protrusion 105 of the press surface 101 is accommodated in each group of the grooves 115, 125, 135 of the press surface 111, 121, 131. Thus, a space having substantially the same shape as the protrusion 15 is formed between the protrusion 105 and the continuous grooves 115, 125, 135. Therefore, when the blank 11A is pressed between the inner die 100 and the outer dies 110, 120, 130, the protrusions 15 can be formed at the same time as the side wall 11, as shown in FIG. 8. The bottom wall 12 is disposed at the lower end position inside the sidewall 11.

Next, in a bottom finishing step of STEP 4, the inside surface of the lower end portion of the blank 11A is heated by a burner or the like to melt the synthetic resin film. Then, the lower folded margin 11*b* (see FIG. 4) of the blank 11A is folded inward by a specific folding tool. Thereafter, a specific circular die is rotated along the lower end of the sidewall 11 so as to stick by pressure the folded portion 11*b* to the standing portion (bent portion) of the bottom wall 12. Next, an upper end finishing step of STEP 5, a specific curling tool of a curling device is rotated along the upper end of the sidewall 11 so as to curl the upper folded margin 11*a* of the blank 11A outward. Moreover, the upper end of the sidewall 11 is pushed by a pushing die so as to round the upper curled portion. Thus, the paper cup 10 shown in FIG. 1 is completed.

According to the second embodiment of the manufacturing method of the paper cup, the protrusion of the safety cup can be formed efficiently by use of a pressure forming that is generally known as a simple forming method. Particularly, the protrusions 15 are formed simultaneously with the sidewall 11 in the paper cup 10. As a result, it is possible to decrease the number of the manufacturing steps of the paper cup and increase the manufacturing efficiency, thereby contributing to reduction of manufacturing costs of the paper cup.

Third Embodiment

Figure 9:
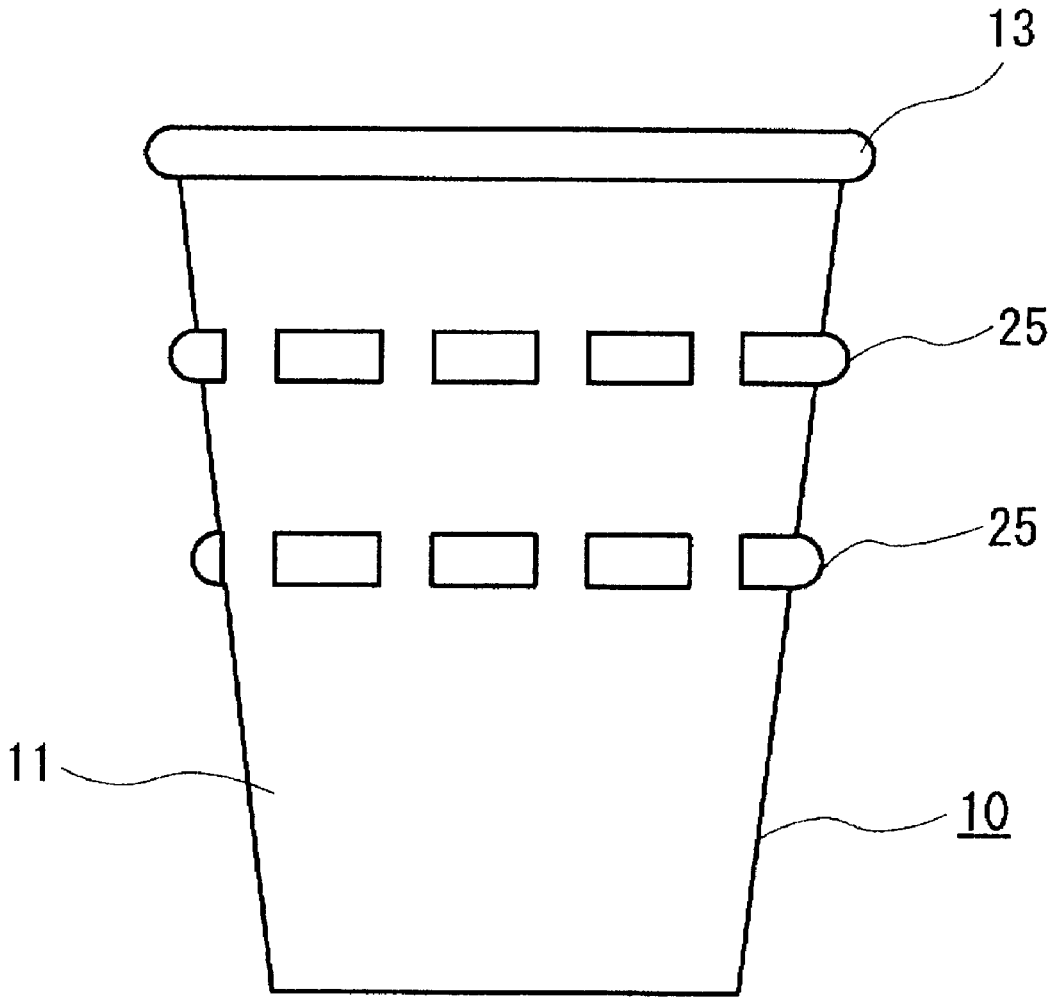
FIG. 9 is a front elevation of a safety cup according to a third embodiment of the invention.

FIG. 9 shows a safety cup according to a third embodiment of the invention.

A third embodiment of a safety cup 10 is different from the first embodiment of the safety cup 10 in a shape of a protrusion. The other structures are same as the first embodiment. Specifically, in the third embodiment, a protrusion 25 of the safety cup defines a broken line that extends along the circumference of the sidewall 11 in its full length. The shape of the protrusion 25 is not limited to the broken line that is separated at an equal distance. It may be formed into a broken line that is separated at a different distance. Alternatively, the protrusion 25 may be made into a chain line such as a one-dot chain line or a two-dot chain line. According to the third embodiment of the safety cup 10, it is possible to form the protrusion 25 easily as in the first and second embodiments. Moreover, the protrusions 25 are formed in two lines in the vertical direction of the sidewall 11 at an interval corresponding to the interval fingers of the user as in the first embodiment. Therefore, the user can make his or her fingers caught respectively and spontaneously on the protrusions 25 in the number (two) corresponding to the number of the protrusions 25. Consequently, the user can grasp the safety cup 10 more stably.

Fourth Embodiment

Figure 10:
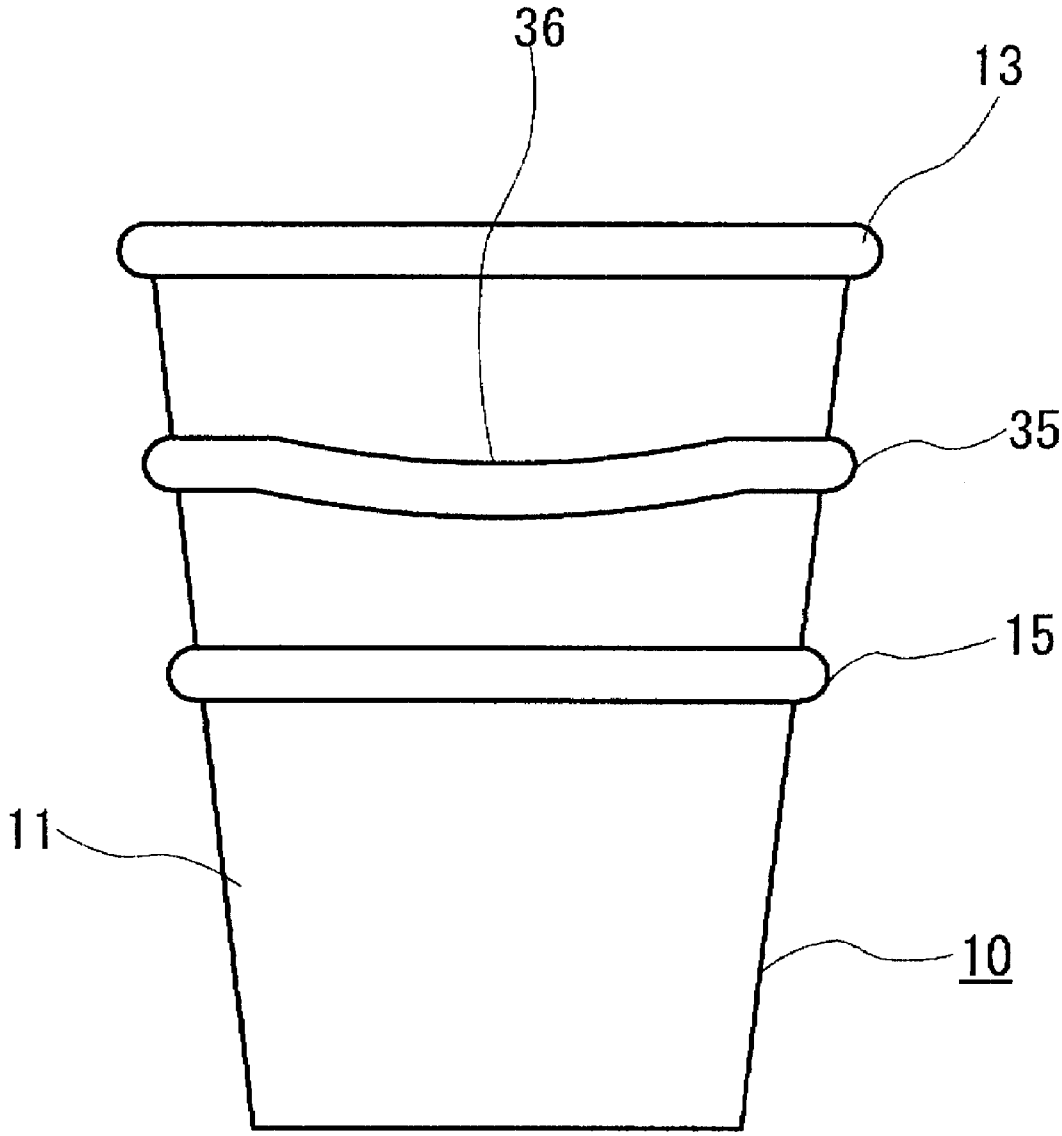
FIG. 10 is a front elevation of a safety cup according to a fourth embodiment of the invention.

FIG. 10 shows a safety cup according to a fourth embodiment of the invention.

A fourth embodiment of a safety cup 10 is different from the first embodiment of the safety cup 10 in a shape of a protrusion. The other structures are same as the first embodiment. Specifically, in the fourth embodiment, the safety cup 10 has the protrusion 15 of the first embodiment arranged at a lower side, while disposing a protrusion 35 at an upper side. The protrusion 35 has a curved portion 36 in part. The protrusion 35 extends along the circumference of the sidewall 11 in its full length. The curved portion 36 extends in the circumferential direction of the sidewall 11 into a shape corresponding to an outer edge shape of a palm between a thumb and a index finger. According to the fourth embodiment of the safety cup 10, the curved portion 36 of the protrusion 35 has the shape matching with the outer edge of the palm of the user. Therefore, the user can grasp the safety cup 10 while completely fitting the outer edge of the palm along the peripheral edge (lower edge) of the curved portion 36 of the protrusion 35. Consequently, the user can grasp the safety cup 10 more stably.

Fifth Embodiment

Figure 11:
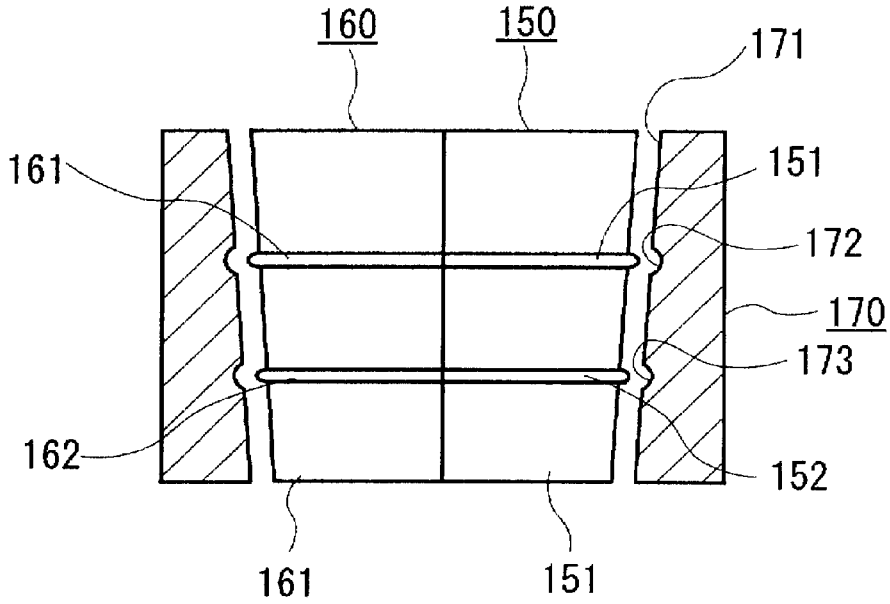
FIG. 11 is a front elevation of a divided die that is used in a manufacturing method of a safety cup according to a fifth embodiment of the invention and that are in a closed state.
Figure 12:
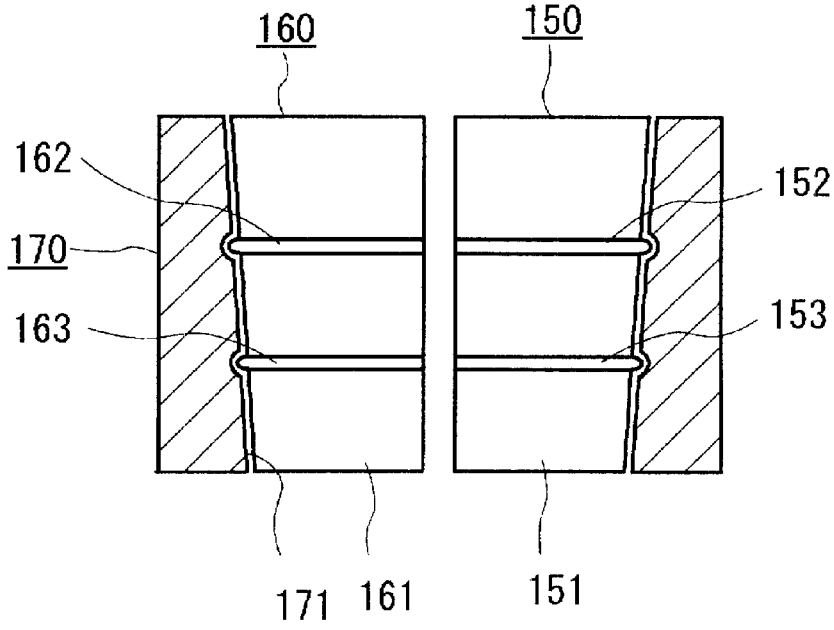
FIG. 12 is a front elevation of the divided die of FIG. 11 in an opened state.

The fifth embodiment relates to a specific forming method of the protrusion 15 of the paper cup 10 according to the first embodiment. FIG. 11 shows a front elevation of a divided die that is used in a manufacturing method of a safety cup according to a fifth embodiment of the invention and that are in a closed state. FIG. 12 illustrates a front elevation of the divided die of FIG. 11 in an opened state.

In the fifth embodiment, pressing dies having a divided die 150, 160 and a receiving die 170 are used in a protrusion-forming step of the paper cup 10. The divided die has a plurality of divided die pieces 150 and 160 that have press surfaces 151 and 161 of shapes corresponding to an inside surface shape of the sidewall 11 including the protrusions 15. An inside of the receiving die 170 has a press surface 171 of a shape corresponding to the outer surface shape of the sidewall 11 including the protrusions 15. Specifically, as shown in FIG. 11, when the divided die pieces 150, 160 are closed, the divided die 150, 160 has a truncated cone shape obtained by contracting a little the inner peripheral surface shape of the upper end portion including the protrusions 15 of the sidewall 11 in the radial direction. The truncated cone shape of the divided die 150, 160 is divided into the plurality by one or more vertical planes including an axis, thereby forming the divided die pieces 150 and 160. The number of the divided die pieces 150, 160 or the division number of the divided die may be two or more as desired. In the fifth embodiment, the divided die has two divided die pieces 150 and 160. Therefore, each divided die piece 150, 160 has a truncated semi-conical shape. On the other hand, the press surface 171 of the receiving die 170 has a truncated cone shape that is same as the outer peripheral surface shape of the sidewall 11. Protrusions 152, 153, 162 and 163 are formed on the press surfaces 151 and 161 of the divided die pieces 150 and 160, respectively. The protrusions 152, 153, 162 and 163 define substantially a ring shape corresponding to the pressed grooves 16 that define the inner surface shapes of the protrusions 15. Grooves 172 and 173 are formed on the press surface 171 of the receiving die 170. Each groove 172, 173 has a shape corresponding to the shape of the outer surface of each of the protrusions 15.

In the fifth embodiment of the manufacturing method of the safety cup, the sidewall 11 is formed at first and then accommodated in the receiving die 170 so as to be supported on the press surface 171 while closely contacted therewith. Next, the divided die pieces 150 and 160 are disposed inside the sidewall 11. At this time, a little gap is provided between the press surfaces 150 and 160 and the inside surface of the sidewall 11. Then, the divided die pieces 150 and 160 are moved away from each other in a radially outward direction, thereby pressing the sidewall 11 between the press surfaces 151, 161 of the divided die 150, 160 and the press surface 171 of the receiving die 170. At the time of pressing, the protrusions 152, 153, 162, 163 of the press surfaces 151, 161 are accommodated in the grooves 172, 173 of the press surface 171. Thus, a space of substantially the same shape as the protrusion 15 is formed between the protrusions 152, 153, 162, 163 and the grooves 172, 173. Consequently, if the sidewall 11 is pressed between the divided die 150, 160 and the receiving die 170, the protrusions 15 are formed on the sidewall 11 without fail. According to the above-mentioned manufacturing method, the protrusions 15 are formed after the sidewall 11 of the safety cup 10 is formed. As a result, since the protrusion-forming step is carried out after the sidewall-forming step, it is possible to simplify the structure of protrusion forming means such as the divided die and so on. Moreover, the protrusions 15 can be formed more easily and smoothly.

In the fifth embodiment, a disc-shaped press roller may be used in place of the divided die 150, 160. Specifically, in case of forming the protrusions 15 in two lines as in the above embodiments, an upper press roller and a lower press roller are arranged on a vertically extending axis in parallel with each other, corresponding to the upper and lower protrusions 15. The press rollers have smaller diameter than the ring-shaped protrusions 15 so that they can smoothly rotate on the inner surface of the sidewall 11 along a locus on which the protrusion 15 is to be made. Since the paper cup 10 has the conical shape and the upper protrusion 15 has a larger diameter than the lower protrusion 15, the upper press roller has a larger diameter than the lower press roller accordingly. In this modification, the receiving die may have a flat press surface instead of the conical press surface 171. Then, the press rollers are rotated on the inner surface of the sidewall 11 along the loci for forming the protrusions 15 provided on the flat press surface of the receiving die. Such locus may be curved since the sidewall 11 has the conical shape and the upper and lower press rollers have different diameters as described above. In this modification, it is possible to form the protrusions 15 on the sidewall 11 easily and smoothly.

Modified Embodiments

The inventive safety cup is not limited to the above-mentioned embodiments but may be practiced in a variety of embodiments. For example, while the safety cup 10 of the above embodiments is made of paper, it may be concretized into a synthetic resin cup or a plastic cup. In this case, the entire shape is same as the paper cup 10, i.e., a hollow reverse truncated cone with a bottom as common plastic cups. The plastic cup may be made of a material or a synthetic resin same as the common plastic cups such as a polyethylene. Moreover, it may be concretized into a thick plastic cup using a low-density synthetic resin such as a low-density polyethylene.

On the other hand, the protrusion as the characteristic feature of the invention is provided on the outer peripheral surface of the sidewall in a ring shape as in the case of the above-mentioned paper cup 10. A manufacturing method of the plastic cup is same as that of the common plastic cups except a protrusion-forming step. Specifically, the plastic cup can be integrally made by injection molding of a synthetic resin such as the polypropylene (PP). Alternatively, the plastic cup may be integrally formed into a final shape by shaping a plastic sheet of a synthetic resin material such as a polystyrene (PS) or a polyethylene by use of a vacuum molding, blow molding or the like. In these cases, the formation of the protrusions is completed at the same time as the formation of the overall safety cup. Moreover, in case of the vacuum molding or the blow molding, grooves for forming the protrusions are arranged on fixed positions of an inside surface of the molding die on which the plastic sheet is pressed, for example.

The inventive safety cup can be concretized into an instant noodle contained or an instant soup container, instead of the paper cup or the plastic cup described above. In this case, the overall shape may be a hollow reverse truncated cone with a bottom that has a sidewall and a bottom wall as in the common instant noodle container or instant soup container. The material may be a paper or a synthetic resin such as a polyethylene as in the common instant noodle container or instant soup container. Moreover, it may be concretized into a thick instant noodle container or a thick instant soup container that uses a low-density synthetic resin such as a low-density polyethylene.

Protrusions as the characteristic feature of the invention are formed on an outer peripheral surface of the sidewall in a ring shape as in the paper cup 10. A manufacturing method of the inventive instant noodle or soup container is same as the common instant noodle or soup container except a protrusion-forming step. The manufacturing method can be the same as that of the paper cup 10 or the plastic cup.

In the invention, ring-shaped protrusions may be prepared separately, for example. Then, the protrusions are joined on the sidewall of the common cup or common container so as to extend along the circumferential direction. In this case, the same function and advantageous effects are obtained as the above-mentioned embodiments, too.

In the inventive safety cup, the protrusion may be composed of many small protrusions (group of small protrusions) of a dot-shape (semi-spherical shape or the like) that are disposed at fixed intervals along the circumference of the sidewall. Moreover, the protrusions may be formed into a variety of shapes. For example, it may be substantially a wave shape or a saw-teeth (zigzag) shape extending along the circumference of the sidewall. Alternatively, it may be a shape arranging many trapezoids and reverse trapezoids by turns successively along the circumference of the sidewall. Moreover, in addition to the protrusions 15, 25, 35 in the above embodiments that extends horizontally or circumferentially of the safety cup 10, sub-protrusions may be provided so as to extend vertically or in the up-and-down direction of the safety cup 10. The sub-protrusions connect the upper and lower protrusions 15, 25, 35 so as to define a ladder shape as a whole.

The inventive safety cup is not limited to the hollow truncated conical shape as mentioned above. It may be a variety of tubular or cylindrical shape such as a simple cylinder or a rectangular cylinder as long as it is cylindrical as a whole. While the protrusion of the safety cup is formed by projecting part of the sidewall outward in the above embodiments, all part of the sidewall other than the portion to be the protrusions may be pressed inward to form dents. In this case, the protrusions are formed as a result at the other portions. Such dent preferably has a shape corresponding to the finger of the user.

The manufacturing method of the inventive safety cup is not limited to those of the first and second embodiments. The other various methods can be used instead. Particularly, in case of the paper cup, the protrusion-forming step can be modified as desired as long as it can form the protrusion on the blank by pressing so that it is protruded outward in such a size and a shape as to hook the finger of the user.

In case of concretizing the inventive safety cup in the paper cup 10 as in the first embodiment, the protrusion-forming step may be performed before the blank-punching step. For example, the material paper is pressed by press rollers such as heat-press rollers at fixed positions where blanks are to be punched, respectively. Thus, the protrusions are formed at the fixed positions of blank-forming portions of the material paper. In this case, a pair of press rollers is arranged so as to face with each other, for example. Protrusion-forming pressing protrusions and dents are formed on the press rollers, respectively, so as to correspond to each of the many blank portions (punched portions) that are arranged in the lateral direction of the material paper. Thus, the protrusions 15A are formed beforehand on the blanks 11A in the same manner as the example of FIG. 4, at the time of punching them.

The number of the protrusions on the safety cup may be one or plural more than two. In case of three or more lines of protrusions, it is preferable to dispose them substantially in parallel with each other at intervals corresponding to the intervals of the fingers of the user.

The safety cup 10 of each embodiment has the shape of hollow reverse truncated cone, so that the outside surface thereof is a tapered surface that makes its diameter smaller toward the lower end. Therefore, many safety cups can be piled up as in the conventional cups. There is no problem in stocking and transporting the safety cups.

The preferred embodiments described herein are illustrative and not restrictive, the scope of the invention being indicated in the appended claims and all variations which come within the meaning of the claims are intended to be embraced therein.

What is claimed is:

1. A cup having a safety structure comprising:

a cylindrical sidewall; and a bottom wall closing a lower end of said sidewall;

said cup having a bottomed cylindrical shape and said sidewall having at least one protrusion protruding outward with such a size and a shape as to hook a finger of a user, and wherein said protrusion has substantially a curved portion extending along a circumference of said sidewall so as to correspond to an outer edge shape of a palm between a thumb and an index finger of said user.

2. A cup according to claim 1, in which the protrusion has substantially a linear shape extending along a circumference of the sidewall.

3. A cup according to claim 1, in which the protrusion has a broken line shape or a dot-chain line shape extending along a circumference of the sidewall.

* * * * *